US005259402A

United States Patent [19]

Brinker

[11] Patent Number: 5,259,402

[45] Date of Patent: Nov. 9, 1993

[54] CIGARETTE HOPPER VANE JAM PREVENTION DEVICE

[75] Inventor: Reiner G. Brinker, Mechanicsville, Va.

[73] Assignee: Philip Morris Incorporated, Va.

[21] Appl. No.: 802,340

[22] Filed: Dec. 4, 1991

[51] Int. Cl.[5] ..... B65B 19/00

[52] U.S. Cl. ..... 131/282; 131/280; 211/68; 53/444; 53/446

[58] Field of Search ..... 131/280, 282, 94; 198/550.5, 550.13; 209/535; 53/444, 446; 221/68, 156, 157, 163, 175; 273/121 B

[56] References Cited

U.S. PATENT DOCUMENTS

| | | | |
|---|---|---|---|
| 1,668,693 | 5/1928 | Molins . | |
| 2,633,133 | 3/1953 | Higgins | 131/74 |
| 2,670,888 | 3/1954 | Avila | 226/14 |
| 2,924,356 | 2/1960 | Pollmann et al. | 221/175 |
| 3,501,052 | 3/1970 | Rudszinat | 221/175 |
| 3,976,085 | 8/1976 | Hall | 131/25 |
| 4,174,780 | 11/1979 | Farrar et al. | 209/536 |
| 4,363,332 | 12/1982 | Preston et al. | 131/282 |
| 4,627,450 | 12/1986 | Focke et al. | 131/282 |
| 4,716,910 | 1/1988 | Gherardi | 131/94 |

FOREIGN PATENT DOCUMENTS

| | | |
|---|---|---|
| 0277363 | 8/1988 | European Pat. Off. . |
| 0443982 | 8/1991 | European Pat. Off. . |
| 2826539 | 1/1979 | Fed. Rep. of Germany . |

OTHER PUBLICATIONS

Hauni-Maschinen 80/81 pp. 88-89, 1981.

*Primary Examiner*—V. Millin
*Assistant Examiner*—J. Doyle
*Attorney, Agent, or Firm*—Charles B. Smith; John J. Cassingham

[57] ABSTRACT

Apparatus and method are disclosed for preventing vane jams in cigarette hoppers. The apparatus and method of the invention are characterized by a plurality of curved elements or guides extending from the back to the front of the hopper. The guides help straighten cigarettes that have become slightly skewed in relation to cigarettes that are correctly positioned in the hopper. The guides also prevent cigarettes that have become skewed to a greater extent or turned perpendicular to correctly positioned cigarettes in a hopper from reaching the vanes of the hopper and causing jam or blockages of the vanes. The guides stop the descent through the hopper of mispositioned cigarettes and cause such cigarettes to slide toward either the front or back wall of the hopper for removal.

18 Claims, 2 Drawing Sheets

CIGARETTE HOPPER VANE JAM PREVENTION DEVICE

BACKGROUND OF THE INVENTION

The present invention relates to improvements in feeding cigarettes through hoppers or other similar containers. The invention will be described throughout with reference to cigarettes only, but it is to be understood that the scope of the invention includes methods and apparatus of the type claimed for feeding any rod-shaped articles.

During the process of packaging cigarettes, it is often necessary to feed the cigarettes through a hopper of the type generally associated with a cigarette packaging machine. Cigarettes are generally fed into the top of the hopper from a tray or Overhead Storage Conveyor And Reservoir (O.S.C.A.R.) Unit (e.g., Molins Limited Model Nos. 1, 2 or 3) and descend in a generally vertical direction into and through the hopper. The cigarettes are withdrawn from the hopper for packaging through a plurality of channels or vanes at the base of the hopper.

In the tray or O.S.C.A.R. Unit and in the hopper, the cigarettes are positioned so that their longitudinal axes are aligned with each other. However, while the cigarettes are being transported to the cigarette packing machine in the tray or as the cigarettes are descending from a tray into and through the hopper, some of the cigarettes can become turned perpendicular or otherwise skewed in relation to the correctly positioned cigarettes so that their longitudinal axes are no longer aligned with the correctly positioned cigarettes. These mispositioned cigarettes descend within the flow of correctly positioned cigarettes and cause jams or blockages of cigarettes in the area of the vanes at the base of the hopper.

Some of the mispositioned cigarettes block or jam the vanes of the hopper by falling across the agitator rods of the hopper. This, in turn, causes a void or area in the hopper in which there are no cigarettes. As cigarettes are withdrawn through the vanes at the base of hopper, other cigarettes tend to fall into such void and cause more cigarettes to become skewed, thus creating more blockages and jams of cigarettes in the area of the vanes of the hopper.

Other mispositioned cigarettes, which have become broken, can also block or fall into and jam the vanes or otherwise disrupt the proper flow of cigarettes through the hopper and vanes. In order to clear such blockages or jams from the vanes, the operator of the cigarette packing machine must stop the machine and remove the mispositioned cigarettes with tweezers or another suitable device. During the clearing process, the vanes, which are usually made of thin sheet metal, are often damaged by the tweezers and require replacement. This causes additional downtime of the machine.

It would, therefore, be desirable to provide a method and apparatus for straightening cigarettes that have become partially skewed with respect to the correctly positioned cigarettes in the hopper. It would also be desirable to provide a method and apparatus for removing from the flow of correctly positioned cigarettes those cigarettes that have become skewed to a greater extent or turned perpendicular with respect to the correctly positioned cigarettes in the hopper. Such a method and apparatus would avoid the blockage and jamming of the vanes at the base of the hopper caused by mispositioned cigarettes. It would also avoid damage caused to the vanes of the hopper during the clearing process.

SUMMARY OF THE INVENTION

The present invention is directed to a vane jam prevention device for a cigarette hopper. The apparatus of the invention comprises a plurality of slightly curved elements or guides, which extend from the rear to the front of a cigarette hopper. The guides are positioned above the vanes of the hopper and are laterally spaced so that a cigarette that has become turned perpendicular or otherwise skewed in relation to the correctly positioned cigarettes in the hopper will fall across the guides.

As cigarettes fall from a tray or O.S.C.A.R. Unit into and through a cigarette hopper fitted with the apparatus of the present invention, cigarettes that have become slightly skewed in relation to the correctly positioned cigarettes in the hopper are straightened by virtue of contacting the guides so that their longitudinal axes become parallel with the correctly positioned cigarettes in the hopper. Cigarettes that have become skewed to a greater extent or turned perpendicular in relation to the correctly positioned cigarettes in the hopper fall across and are stopped by the guides. By stopping the flow of these mispositioned cigarettes, the guides prevent such cigarettes from blocking or jamming the vanes of the hopper and the damage to the vanes that may be caused during the clearing process.

Due to the curvature of the guides, mispositioned cigarettes that fall across a single guide or adjacent guides slide along the guide or guides away from the descent path of correctly positioned cigarettes and toward either the front doors or back plate of the hopper. Cigarettes that slide toward the back plate of the hopper are pushed out of the hopper by the guides, as the oscillating back plate of the hopper opens. Cigarettes that slide toward the front doors of the hopper are held in place by the guides where they can be easily removed by the operator of the cigarette packaging machine.

BRIEF DESCRIPTION OF THE FIGURES

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
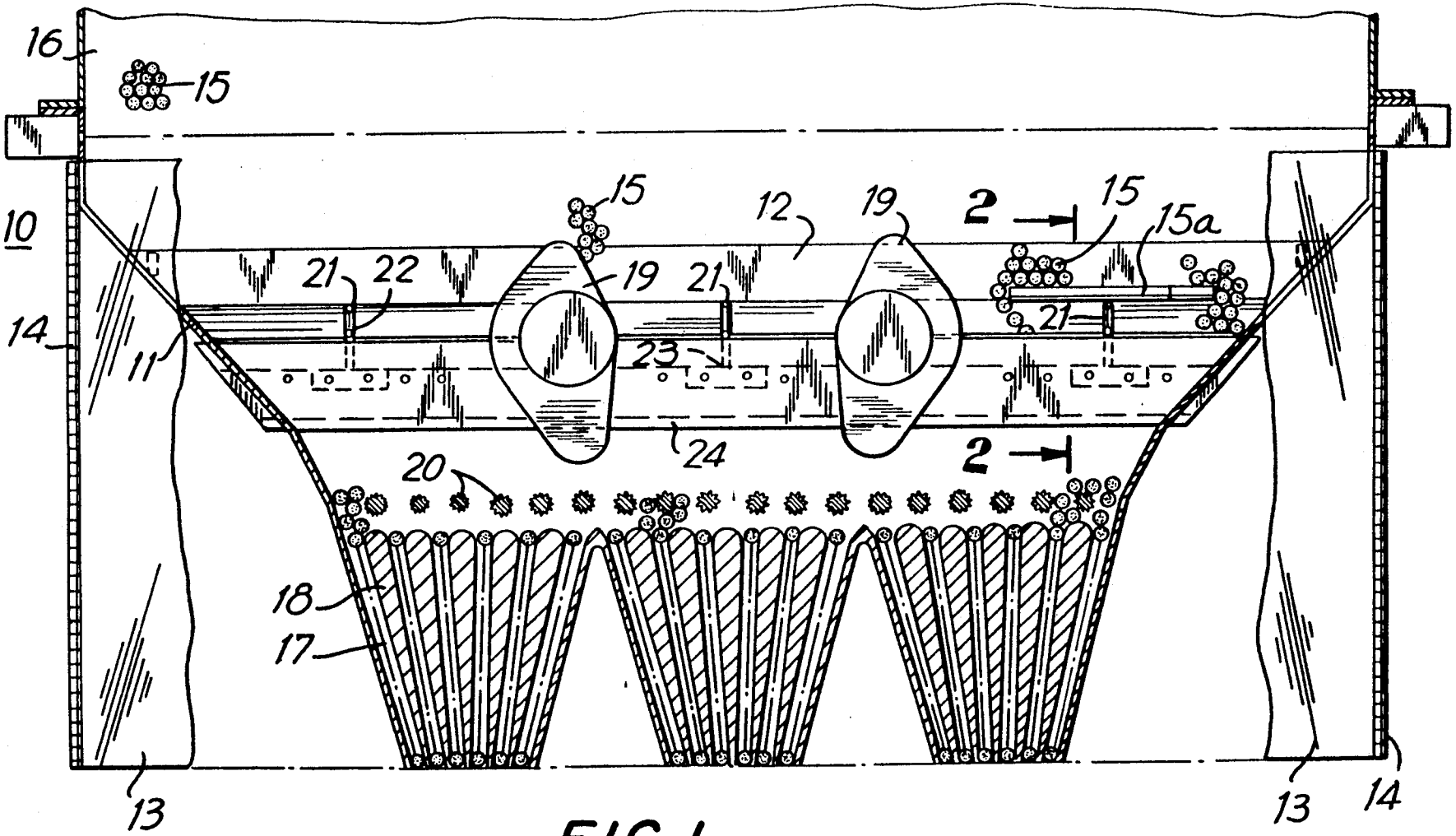
FIG. 1 is a front elevated view, partly in section, of the hopper.

FIG. 1 shows a hopper 10 of the type which is generally associated with a cigarette packing machine. Hopper 10 is bounded on each end by sidewall or sideplates 11, on the back by a back plate 12 and in the front by transparent plastic doors 13. The back plate 12 of hopper 10 oscillates so that cigarettes in the hopper are pushed toward the inside of front doors 13. Front doors 13 of hopper 10 are attached to the hopper by means of hinges 14 and can be easily opened by the operator of the machine.

As shown in FIG. 1, cigarettes 15 are supplied to hopper 10 from a tray 16, which rests on top of the hopper 10. Cigarettes may also be supplied to the hopper from a conveyor or O.S.C.A.R. Unit (not shown). In the tray 16 or O.S.C.A.R. Unit and in the hopper 10, cigarettes 15 have their longitudinal axes aligned with each other and perpendicular to the plane formed by front doors 13 of hopper 10. Such cigarettes are correctly positioned cigarettes. Cigarettes in tray 16 fall into hopper 10 and descend in a generally vertical path through the hopper. Cigarettes 15 are withdrawn from hopper 10 along paths 17 formed by vanes 18.

Plastic deflectors 19 in hopper 10 help guide the cigarettes through the hopper and toward vanes 18. Rotatable knurled agitator rods 20, supported from behind back plate 12 of hopper 10, extend through holes in back plate 12 and are positioned immediately above vanes 18. The agitator rods 20 are rotated, all in the same direction, by conventional drive means (not shown) and help guide the cigarettes 15 into the pathways 17 defined by the vanes 18. The cigarettes 15 are withdrawn through pathways 17 and are received on a tray-like receiving bed (not shown) for packaging.

As shown in FIG. 1, correctly positioned cigarettes 15 having their longitudinal axes aligned with each other, fall from tray 16 and descend into and through hopper 10. As shown in FIG. 1, some cigarettes **15*a* may become turned perpendicular or otherwise skewed in relation to correctly positioned cigarettes 15 descend into and through hopper 10 together with the correctly positioned cigarettes. Such mispositioned cigarettes may block agitator rods 20 and vanes 18 of hopper 10. For example, mispositioned cigarettes may fall across adjacent agitator rods 20 and cause a void in the area of hopper 10 below the agitator rods. Due to the downward movement of correctly positioned cigarettes 15 through hopper 10, other cigarettes which had been correctly positioned may drop into the void and become mispositioned. This, in turn, can cause other correctly positioned cigarettes to do the same, resulting in additional jams or blockages of vanes 18**.

Figure 2:
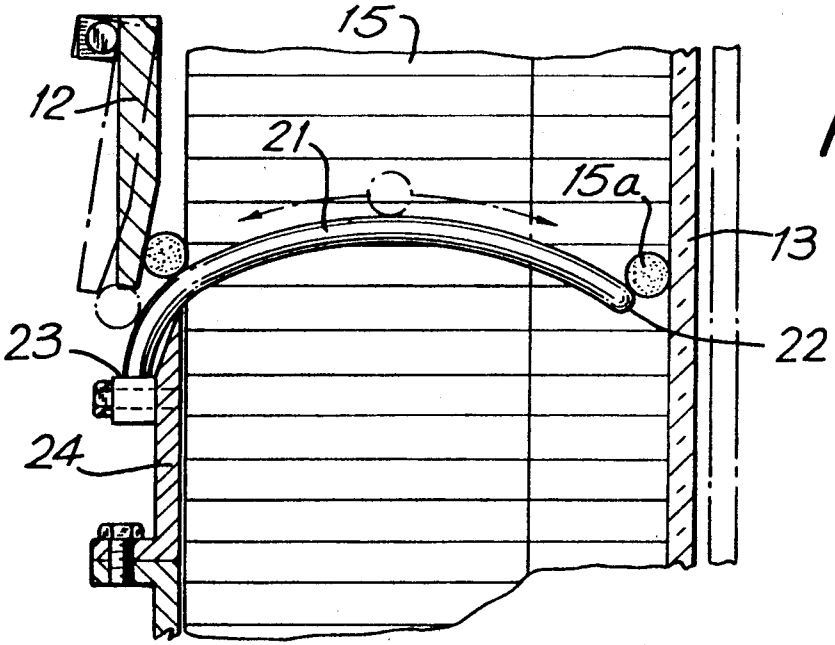
FIG. 2 is a vertical cross-sectional view taken generally along line 2—2 of FIG. 1.

In accordance with the present invention, a plurality of laterally spaced curved elements or guides 21 are positioned in hopper 10 above the vanes of the hopper. As shown in FIG. 2, the guides 21 extend from the back to the front of hopper 10. The guides 21 define flow passages for correctly positioned cigarettes 15 so that the correctly positioned cigarettes descend into and through hopper 10 and pathways 17 formed by vanes 18. Mispositioned cigarettes **15*a* are held up across an individual guide or adjacent guides 21, while correctly positioned cigarettes 15 continue to descend through hopper 10 and toward vanes 18**.

As shown in FIG. 2, due to the curvature of guides 21, mispositioned cigarettes **15*a* that have fallen across the guides slide away from the flow path of correctly positioned cigarettes 15 and toward either back plate 12 or front doors 13 of hopper 10. If a mispositioned cigarette slides toward back plate 12 of hopper 10, it will fall out of hopper 10 when back plate 12 of hopper 10 opens. If a mispositioned cigarette 15*a* slides along guides 21 toward front doors 13 of hopper 10, ends 22 of guides 21 will typically hold such cigarette in place, so that it can be easily removed by the operator of the cigarette packaging machine. In the event that a mispositioned cigarette slips into the space between the ends 22 of guides 21 and front doors 13 of hopper 10, it can also be easily removed by the operator of the machine before such cigarette descends to and possibly jams or blocks vanes 18**.

The guides 21 are preferably made of wire. However, they may be formed from any other suitable material, such as plastic. One end 23 of each guide 21 is attached to hopper 10 by means of a mounting bracket 24 located below back plate 12 of hopper 10. Alternatively, the guides may be mounted to a back wall of the hopper. Ends 23 of guides 21 include slots so that the position guide may be adjusted laterally to enhance the flow of cigarettes through the hopper. Guides 21 may be attached by bolts or other suitable means to mounting bracket 24. Ends 22 of guides 21 are rounded so that they will not tear the paper of a cigarette or cause injury to the operator of the machine while the operator is removing a mispositioned cigarette from the hopper.

As shown FIG. 2, guides 21 are curved in a downward direction, i.e, the end portions of guides 21 are lower than the respective center portions so that mispositioned cigarettes **15*a* that have fallen across the guides 21 slide toward either the front doors 13 or the back plate 12 of hopper 10. While the degree of curvature of the portion of guides 21 which are inside hopper 10 is not critical, the curvature should be great enough so that a mispositioned cigarette 15*a* lying across guides 21 will slide toward either the front doors 13 or back plate 12 of hopper 10. However, as shown in FIG. 2, guides 21 should be curved sufficiently so that the end 23 of guide 21 can be attached to mounting bracket 24**.

As shown in FIG. 2, guides 21 should be long enough so that they extend from back plate 12 to front doors 13 of hopper 10. The length of guides 21 may vary with the curvature of the guides and the length of the cigarettes in the hopper. For example, hoppers for longer cigarettes, i.e, 100 mm cigarettes, would generally require longer guides than a hopper for 80 mm cigarettes.

Figure 3:
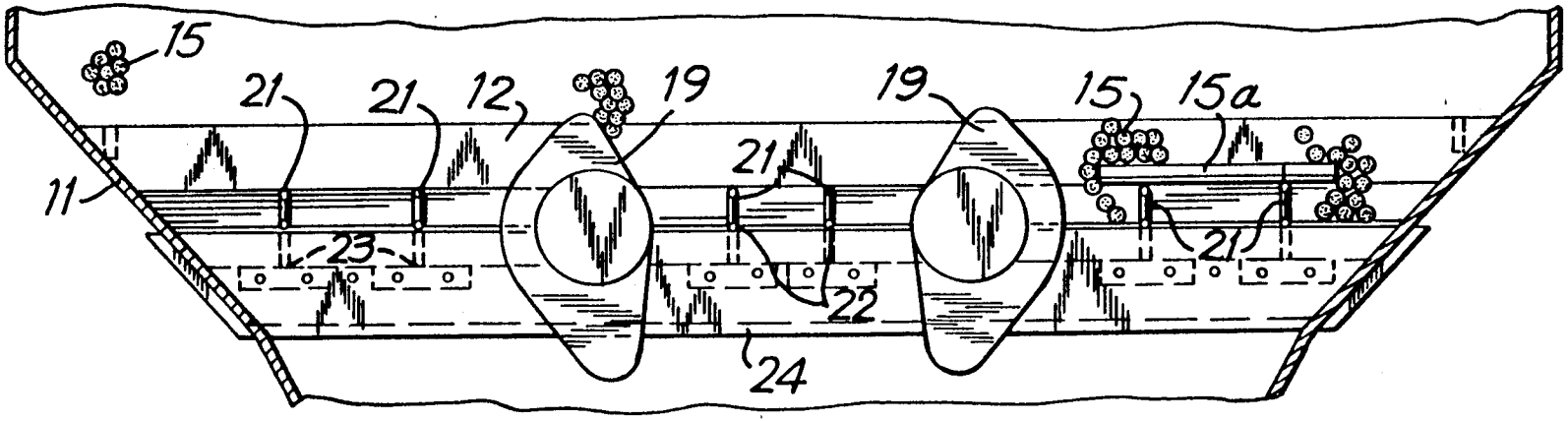
FIG. 3 is a front elevated view, partly in section, of an alternative embodiment of the invention.

Guides 21 are positioned above vanes 18 and agitator rods 20 of hopper 10. Preferably, the guides 21 are mounted along a horizontal line parallel to the plane which forms the top of the hopper. As shown in FIGS. 1 and 3, the guides 21 are preferably positioned in a horizontal line across hopper 10. The number of guides 21 utilized in a given hopper will vary in accordance with the width of the hopper, the width of the guides and the length of the cigarettes in the hopper. Additional guides may be utilized for shorter cigarettes, i.e., 80 mm cigarettes. As shown in FIG. 3, such additional guides may be attached to mounting bracket 24 on the back side of hopper 10, as described above.

Guides 21 should be spaced so that the distance between adjacent guides 21 or the distance between an individual guide 21 and a plastic deflector 19 or the distance between a guide 21 and a sidewall 11 of hopper 10 is greater than the diameter of the cigarettes in the hopper, but less than the length of the cigarettes. Preferably, this distance is approximately equal to one-half of the length of a cigarette in the hopper. This allows guides 21 to catch mispositioned cigarettes that have also become broken off at the filter, or otherwise damaged, thus preventing those cigarettes from blocking or jamming vanes 18 of hopper 10.

The width of guides 21 is preferably about 5 mm. Narrower or wider guides may also be used in accordance with the present invention. However, the width of an individual guide should not be so narrow that it causes a mispositioned cigarette which lands across the guide to be cut in half. This may result in the damaged pieces of such cigarette descending through the hopper and potentially blocking or jamming the vanes of the hopper as described above. The width of an individual guide should also not be so wide as to disrupt the flow of correctly positioned cigarettes 15 through hopper 10.

Although the present invention has been described in detail with reference to the preferred embodiment, many variations and modifications thereof will now be apparent to those skilled in the art. Accordingly, the scope of the invention is to be limited not by the details of the embodiment illustratively described herein, but by the terms of the claims that follow.

I claim:

1. An apparatus for feeding rod-shaped articles, comprising:

a hopper having a rear wall, a front wall and two side walls, a plurality of arcuate guides laterally spaced between the side walls and defining passages for the flow of rod-shaped articles through said hopper, each of said guides being attached at a rear end thereof to the rear wall and extending forwardly across the interior of the hopper toward said front wall and having a front end adjacent said front wall such that said rear end and said front end of each of said guides is lower than a respective intermediate portion thereof.

2. The apparatus of claim 1, wherein said hopper is a cigarette hopper and said rod-shaped articles are cigarettes.

3. The apparatus of claim 1, wherein at least one end of at least one of said guides is rounded.

4. The apparatus of claim 1, wherein said guides comprise wire guides.

5. The apparatus of claim 1, wherein said guides comprise plastic guides.

6. The apparatus of claim 1, wherein the number of guides is three.

7. The apparatus of claim 1, wherein the number of guides is five.

8. The apparatus of claim 1, wherein at least one end of at least one of said guides is slotted.

9. An apparatus for feeding rod-shaped articles, comprising:

a hopper bounded on a front side by doors and on a back side by a plate and a bracket;

a plurality of laterally spaced arcuate guides defining passages for the flow of rod-shaped articles through said hopper, each of said guides being attached at a rear end thereof to said bracket and extending forwardly across the interior of the hopper toward said doors and having a front end adjacent said doors such that said rear end and said front end of each of said guides is lower than a respective intermediate portion thereof.

10. The apparatus of claim 9, wherein said hopper is a cigarette hopper and said rod-shaped articles are cigarettes.

11. The apparatus of claim 9, wherein at lest one end of at least one of said guides is rounded

12. The apparatus of claim 9, wherein said guides comprise wire guides.

13. The apparatus of claim 9, wherein said guides comprise plastic guides.

14. The apparatus of claim 9, wherein the number of guides is three.

15. The apparatus of claim 9, wherein the number of guides is five.

16. The apparatus of claim 9, wherein the front doors comprise transparent plastic front doors.

17. The apparatus of clam 9, wherein at least one end of at least one of said guides is slotted.

18. The apparatus of claim 9, wherein said plate oscillates.

* * * * *